US009338868B2

(12) United States Patent
Yabugami

(10) Patent No.: US 9,338,868 B2
(45) Date of Patent: May 10, 2016

(54) RADIOGRAPHIC EQUIPMENT

(75) Inventor: Katsuhiro Yabugami, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 1022 days.

(21) Appl. No.: 13/479,586

(22) Filed: May 24, 2012

(65) Prior Publication Data

US 2013/0315378 A1 Nov. 28, 2013

(51) Int. Cl.
*H05G 1/32* (2006.01)

(52) U.S. Cl.
CPC ..... *H05G 1/32* (2013.01)

(58) Field of Classification Search
CPC ..... H05G 1/34; H05G 1/54; H05G 1/265; A61B 6/586; G08B 23/00
See application file for complete search history.

(56) References Cited

FOREIGN PATENT DOCUMENTS

| | | | |
|---|---|---|---|
| JP | 55159596 A | * | 12/1980 |
| JP | 56159097 U | * | 11/1981 |
| JP | 9-161990 A | | 6/1997 |
| JP | 2011115369 A | * | 6/2011 |

* cited by examiner

*Primary Examiner* — David J Makiya
*Assistant Examiner* — John Corbett
(74) *Attorney, Agent, or Firm* — McDermott Will & Emery LLP

(57) ABSTRACT

A filament current that is to be supplied to a filament of an x-ray tube under imaging conditions, from the imaging conditions of the tube current and the tube voltage that is to be supplied to the x-ray tube at the time of radiographic imaging, are stored as a filament current setting value in a storing portion, and the difference between an anticipated value for the tube current when x-ray emission is performed at a given filament current and a measured value for the tube current when x-ray emission is actually performed at that filament current is measured over time as a tube current value difference, and when the mean value for the tube current value difference over a specific time interval exceeds a setting value that has been set in advance, the filament current setting value that is stored in the storing portion is corrected.

5 Claims, 5 Drawing Sheets

FIG. 5

(a)

| | 40kV | 60kV | 80kV | 100kV | 110kV | 125kV |
|---|---|---|---|---|---|---|
| 20mA | 3.69 | 3.65 | 3.63 | 3.62 | 3.61 | 3.60 |
| 63mA | 4.06 | 4.03 | 4.00 | 3.99 | 3.97 | 3.96 |
| 125mA | 4.31 | 4.28 | 4.24 | 4.22 | 4.21 | 4.20 |
| 200mA | 4.57 | 4.48 | 4.43 | 4.40 | 4.39 | 4.38 |
| 360mA | 4.90 | 4.80 | 4.71 | 4.67 | 4.65 | 4.64 |
| 400mA | 4.95 | 4.85 | 4.76 | 4.71 | 4.69 | 4.68 |

(b)

| | 40kV | 60kV | 80kV | 100kV | 110kV | 125kV |
|---|---|---|---|---|---|---|
| 20mA | 3.68 | 3.64 | 3.62 | 3.61 | 3.60 | 3.59 |
| 63mA | 4.05 | 4.02 | 3.99 | 3.98 | 3.96 | 3.95 |
| 125mA | 4.29 | 4.26 | 4.22 | 4.20 | 4.19 | 4.18 |
| 200mA | 4.55 | 4.46 | 4.41 | 4.38 | 4.37 | 4.36 |
| 360mA | 4.88 | 4.78 | 4.69 | 4.65 | 4.63 | 4.62 |
| 400mA | 4.93 | 4.83 | 4.74 | 4.69 | 4.67 | 4.66 |

FIG. 6

| Date | Tube Current Expected Value (mA) | Tube Current Measured Value (mA) | Error (%) |
|---|---|---|---|
| July 1 | 400 | 414 | +3.5 |
| July 2 | 360 | 470 | +2.8 |
| July 3 | 450 | 465 | +3.3 |
| July 4 | 500 | 522 | +4.4 |
| July 5 | 400 | 459 | +7.3 |
| | | | |

FIG. 7

| Correction Date | Number of Corrections in One Month |
|---|---|
| 06/05/2009 | 1 |
| 09/12/2009 | 1 |
| 11/25/2009 | 1 |
| 12/30/2009 | 1 |
| 01/15/2010 | 2 |
| 02/01/2010 | 2 |
| 02/07/2010 | 3 (Warning displayed.) |

FIG. 8

(a)

| | 40kV | 60kV | 80kV | 100kV | 110kV | 125kV |
|---|---|---|---|---|---|---|
| 20mA | 3.69 | 3.65 | 3.63 | 3.62 | 3.61 | 3.60 |
| 63mA | 4.06 | 4.03 | 4.00 | 3.99 | 3.97 | 3.96 |
| 125mA | 4.31 | 4.28 | 4.24 | 4.22 | 4.21 | 4.20 |
| 200mA | 4.57 | 4.48 | 4.43 | 4.40 | 4.39 | 4.38 |
| 360mA | 4.90 | 4.80 | 4.71 | 4.67 | 4.65 | 4.64 |
| 400mA | 4.95 | 4.85 | 4.76 | 4.71 | 4.69 | 4.68 |

(b)

| | 40kV | 60kV | 80kV | 100kV | 110kV | 125kV |
|---|---|---|---|---|---|---|
| 20mA | 3.68 | 3.64 | 3.62 | 3.61 | 3.60 | 3.59 |
| 63mA | 4.05 | 4.02 | 3.99 | 3.98 | 3.96 | 3.95 |
| 125mA | 4.30 | 4.27 | 4.23 | 4.21 | 4.20 | 4.19 |
| 200mA | 4.56 | 4.47 | 4.42 | 4.39 | 4.38 | 4.37 |
| 360mA | 4.89 | 4.79 | 4.70 | 4.66 | 4.64 | 4.63 |
| 400mA | 4.94 | 4.84 | 4.75 | 4.70 | 4.68 | 4.67 |

(c)

| | 40kV | 60kV | 80kV | 100kV | 110kV | 125kV |
|---|---|---|---|---|---|---|
| 20mA | 3.70 | 3.66 | 3.64 | 3.63 | 3.62 | 3.61 |
| 63mA | 4.07 | 4.04 | 3.41 | 3.40 | 3.98 | 3.97 |
| 125mA | 4.32 | 4.29 | 4.25 | 4.23 | 4.22 | 4.21 |
| 200mA | 4.58 | 4.49 | 4.44 | 4.41 | 4.40 | 4.39 |
| 360mA | 4.61 | 4.81 | 4.72 | 4.68 | 4.66 | 4.65 |
| 400mA | 4.96 | 4.86 | 4.77 | 4.72 | 4.70 | 4.69 |

RADIOGRAPHIC EQUIPMENT

CROSS REFERENCE TO RELATED APPLICATION

This application is based on Japanese Patent Application No. 2009-275301 filed Dec. 3, 2009, which is incorporated herein by reference. This application was published Jun. 16, 2011 as JP 2011-115369.

FIELD OF TECHNOLOGY

The present invention relates to radiographic equipment for detecting, by an x-ray detector, x-rays that have been emitted from an x-ray tube and that have passed through an examination subject.

BACKGROUND

X-ray tubes that are used in this type of radiographic equipment have structures that produce x-rays through collisions with an anode of thermal electrons that are from a cathode that is provided with a filament. Given this, when the electric current value of the filament current that is provided to the filament becomes large, more thermal electrons will be emitted from the cathode toward the anode, increasing the value of the tube current, to thereby cause the emission of a larger dose of x-rays.

In such an x-ray tube, the filament of the x-ray tube degrades down over time. Moreover, it is known that when the filament of the x-ray tube undergoes degradation, the tube current in the x-ray tube will become larger, even when the filament current that is provided to the filament is held constant. Thus when a filament that breaks down with the passage of time is used with the same filament current, the value of the tube current will become larger, not only producing x-rays of a dose that is larger than what is necessary, but also increasing the temperature of the filament and increasing the amount of heat produced by the filament, which further causes the filament to become even narrower, accelerating the rate with which it undergoes degradation.

Because of this, measuring the actual value of the tube current of the x-ray tube when emitting x-rays, and performing feedback control of the value of the electric current for the filament current accordingly, makes it possible to maintain the tube current at a constant value. However, in an x-ray tube the response speed of the filament temperature relative to the value of the filament current that is applied to the filament is relatively slow, so a some amount of time is required in order to stabilize the tube current value and the tube voltage value. Because of this, unless x-rays are emitted over a relatively long period of time, in order to perform such feedback control, it is not possible to perform feedback control accurately through differences in the tube current value, or the like.

Because of this, in the x-ray generating device set forth in Japanese Unexamined Patent Application Publication H9-161990 ("JP '990"), an initial value for the data that indicates the relationship between the tube current value and the filament current value, and data that indicates the relationship between the tube current value and the filament current value at the present point in time, are compared, to calculate the value of the filament current for producing the required tube current value.

While the tube current value will vary over time when the filament current value is constant, the tube current value undulates over time. Because of this, as described in JP '990, when the filament current value has been corrected using the measured value at a given point in time as-is, the variability of differences in the measured values will be reflected as-is into the correction values, so that the corrections will not always be accurate. Moreover, even when there is error in the measured value, that error will be reflected as-is into the correction value.

The present invention was created in order to resolve issues such as set forth above, and the object thereof is to provide radiographic equipment wherein variability in the tube current values accompanying degradation of the filament in an x-ray tube can be corrected appropriately by reducing the effects of variability of differences over time and of measurement error.

Moreover, in such radiographic equipment, the filament breaking at the time of an x-ray examination, preventing the x-rays from being emitted from the x-ray tube, may endanger the life or safety of the patient, depending on the condition of the patient that is the subject of the examination.

The present invention is to solve the problems set forth above, and a second object thereof is to provide radiographic equipment wherein it is possible to anticipate the failure of the radiographic equipment due to the service life of filament.

The invention as set forth is radiographic equipment for detecting, by an x-ray detector, x-rays that have been emitted from an x-ray tube and that have passed through an examination subject, including storing means for storing, as a filament current setting value, a filament current that is to be supplied to a filament of an x-ray tube under imaging conditions, from the imaging conditions of the tube current and tube voltage that are to be supplied to the x-ray tube at the time of radiographic imaging; tube current value difference measuring means for measuring over time, as a tube current value difference, a difference between an anticipated value for the tithe current when x-ray emission is performed at a given filament current and a measured value for the tube current when x-ray emission is actually performed at that filament current; and filament current setting value correcting means for correcting the filament current setting value that has been stored in the storing means so that the tube current value difference is reduced when a calculation processing value for the tube current value difference during a specific period exceeds a setting value that has been set in advance.

The invention as set forth is radiographic equipment as set forth above, wherein: the calculation processing value for the tube current difference during the specific interval is a mean value or a weighted average value of the tube current difference.

The invention also includes warning displaying means for displaying a warning regarding the filament service life when a correcting frequency for the filament current setting value exceeds a specific setting frequency in a given time interval.

An embodiment of the invention includes the filament current setting value correcting means correct the filament current setting value by a minimum correction value that is smaller than a correction value for the filament current corresponding to the current value difference when the calculation processing value for the tube current value difference during the specific interval exceeds a setting value that has been set in advance.

The radiographic equipment as set forth includes when the tube current value difference is a difference wherein the tube current value is increased, the filament current setting value correcting means making a correction to reduce the filament current setting value, and when the tube current value difference is a difference wherein the tube current value is increased, do not make a correction to the filament current setting value.

The inventions as make it possible to correct accurately variability in the tube current value accompanying degradation of the filament in an x-ray tube by reducing the effect of variability of differences over time and of measurement errors, through correcting the filament current setting value based on a calculation process value for the electric current value differences over a specific time interval.

The invention as set forth also makes it possible to anticipate in advance failures of the radiographic equipment that occurred due to the service life of the filament, through monitoring the state of corrections of the filament current setting value.

The examples above make it possible to correct the filament current setting value gradually, even when there is a variability in differences over time or when there is measurement error, through correcting the filament current setting value by a minimum correction value that is smaller than the correction value for the filament current corresponding to the electric current value difference.

The invention makes it possible to perform the correction in accordance with the degradation characteristics of the filament, and possible to prevent an excessive increase in the filament current value, through correcting the filament current value setting to be smaller when there is a tube current value difference wherein the tube current value has increased, and not correcting the filament current value setting when there is a tube current value difference wherein the tube current value has decreased.

BRIEF EXPLANATION OF THE DRAWINGS

FIG. 5 is a table illustrating the relationships between the tube currents and tube voltages that are to be supplied to the x-ray tube 3, and the filament current value settings at those times.

FIG. 6 is a table illustrating the differences between the anticipated values of the tube currents and the measured values for those tube currents, measured on a daily basis.

FIG. 7 is a table illustrating the correction dates, and the number of corrections, of the filament current value settings.

FIG. 8 is a table illustrating the relationships between the tube currents and tube voltages that are to be supplied to the x-ray tube 3, and the filament current value settings at those times.

DETAILED DESCRIPTION

Figure 1:
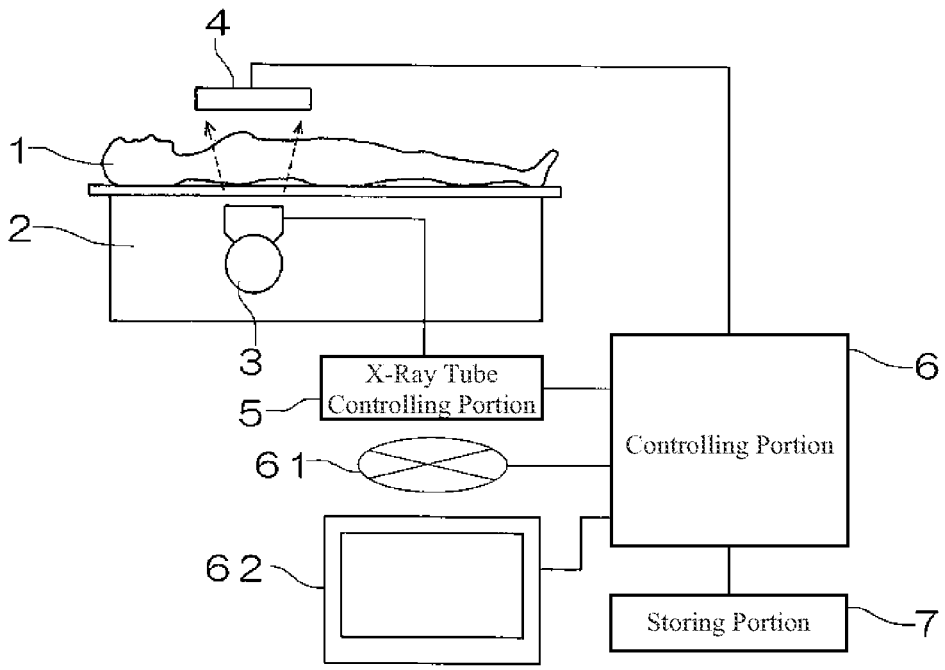
FIG. 1 is a schematic diagram of radiographic equipment according to the present invention.

Examples of the present invention will be explained below, based on the drawings. FIG. 1 is a schematic diagram of an x-ray device according to the present invention.

This radiographic equipment includes a table 2 on which is placed the examination patient 1, who is the examination subject; an x-ray tube 3; a flat panel detector 4; an x-ray tube controlling portion for controlling the tube voltage and tube current applied to the ray tube 3; a controlling portion 6, a storing portion 7, a connecting portion 61 for connecting to a network, such as the Internet, or the like; and a displaying portion 62, such as a CRT, or the like.

This radiographic equipment has a structure wherein x-rays are emitted from the x-ray tube 3 towards the examination patient 1 on the table 2, the x-rays that pass through the examination patient 1 are detected by the flat panel detector 4, image processing of the detected x-rays is performed in the controlling portion 6, and the radiographic image is displayed on the displaying portion 62 using a video signal from the x-rays for which image processing was performed.

Figure 2:
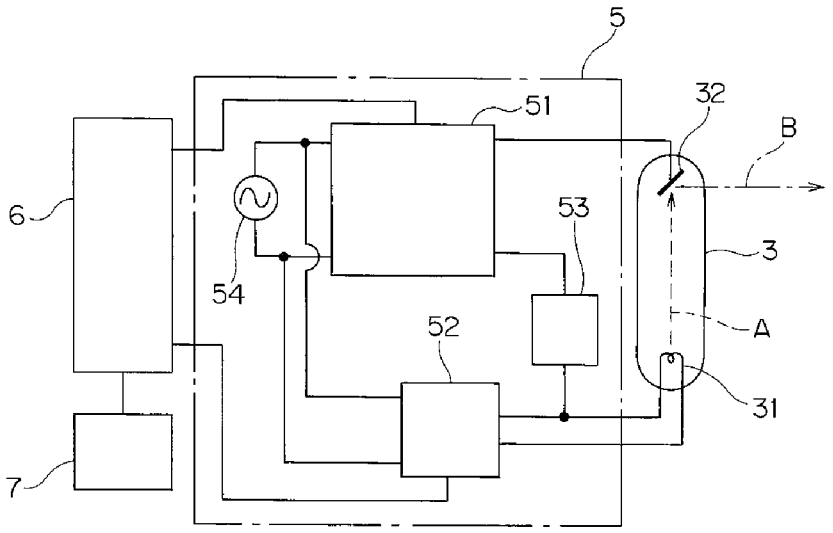
FIG. 2 is a block diagram illustrating the x-ray tube controlling portion 5 together with the x-ray tube 3, the controlling portion 6, and the storing portion 7.

FIG. 2 is a block diagram illustrating the aforementioned x-ray tube controlling portion 5 together with the x-ray tube 3, the controlling portion 6, and the storing portion 7.

The x-ray tube controlling portion 5 is provided with a high voltage supplying circuit 51 and a filament current supplying circuit 52 that are connected to a commercial AC power supply 54. The high voltage supplying circuit 51 receives a controlling signal from the controlling portion 6, to control the tube voltage that is supplied to the x-ray tube 3. Moreover, the filament current supplying circuit 52 receives a controlling signal from the controlling portion 6 to control the filament current that is applied to the filament 31 of the x-ray tube 3. In the x-ray tube 3, thermal electrons are produced by the filament 31 of the anode that is heated through the application of the filament current. These thermal electrons A collide with the cathode 32 to emit x-rays B. At this time, the value of the tube current when the x-ray tube 3 is emitting x-rays is detected by a tube current detecting portion 53.

Note that the aforementioned storing portion 7 functions as storing means for storing, as a filament current setting value, the filament current that is to be applied to the filament 31 of the x-ray tube 3 under the imaging conditions of the tube current and tube voltage that are to be supplied to the x-ray tube 3 at the time of radiographic imaging. Moreover, the aforementioned tube current detecting portion 53 functions together with the controlling portion 6 as tube current value difference measuring means for measuring, as a tube current value difference, over time, the differences between anticipated values for the tube current when x-ray emission is performed with a constant filament current and the measured values for the tube current when the x-ray emission is actually perform with that filament current. Moreover, the aforementioned filament current supplying circuit 52 functions, together with the controlling portion 6, as filament current setting value correcting means for correcting the filament current setting value, which is stored in the storing portion 7, when an average value, over a specific time interval, of the tube current value difference exceeds a setting value that has been set in advance.

Figure 3:
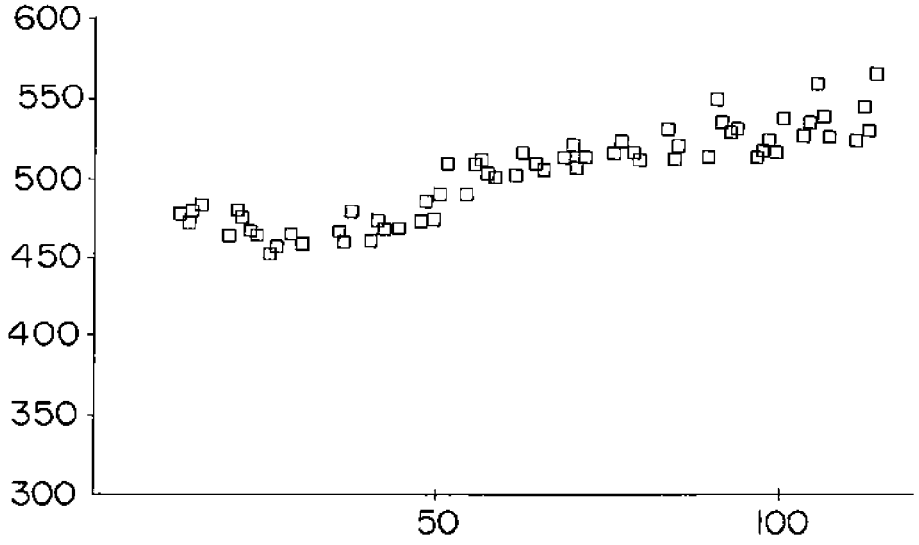
FIG. 3 is a graph illustrating the variability in the tube current value when the filament current value is held constant.

FIG. 3 is a graph showing the variability in the tube current value when the filament current value is held constant. Note that, in this graph, the vertical axis shows the tube current values and the horizontal axis shows the number of days elapsed.

This graph shows what types of variability there is over time in the actual tube current value when the filament current value is maintained at a constant value for which the tube current value is anticipated to be 500 mA. As can be seen in this graph, as the filament degrades, the tube current value gradually increases, even though a constant filament current value is maintained. However, the tube current value does not increase linearly with this degradation, but rather it can be seen that it gradually increases while repetitively increasing and decreasing.

Figure 4:
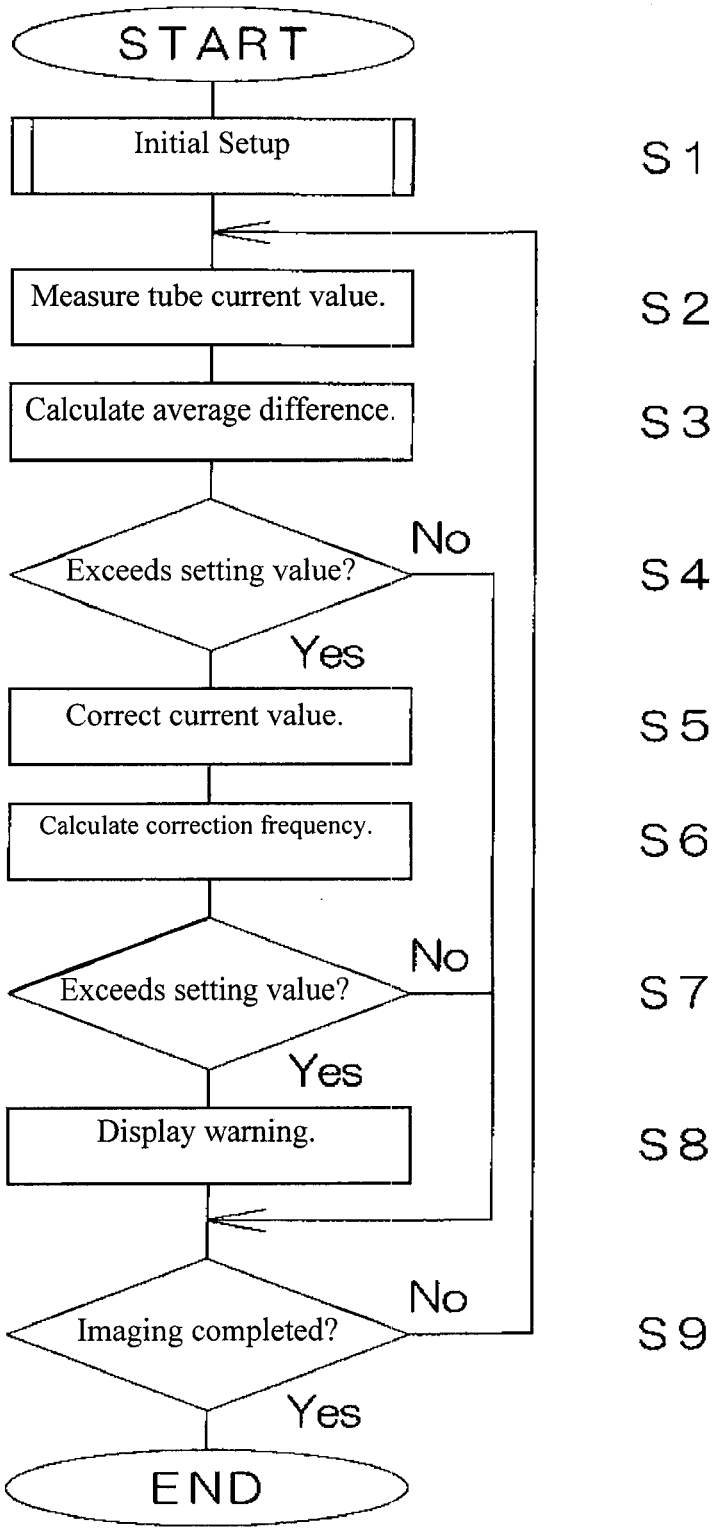
FIG. 4 is a flowchart illustrating the correcting operation, and the like, for the filament current value in the radiographic equipment according to the present invention.

The correcting operation for correcting the filament current value that is supplied to the filament 31 accompanying the degradation of the filament 31 in the x-ray tube 3 in the radiographic equipment having the structure described above will be explained next. FIG. 4 is a flowchart, illustrating the correcting operation, and the like, for the filament current value in the radiographic equipment according to the present invention.

In this radiographic equipment, initial setup is performed at the time of equipment installation, or the like (Step S1). At the time of this initial setup, the filament current values that are to be supplied to the filament 31 of the x-ray tube 3 under the imaging conditions are set up as the filament current setting values, based on the tube currents and tube voltages that are to be supplied to the x-ray tube 3 in order to accommodate the imaging conditions for performing the radiographic imaging. The relationships between the tube currents and tube voltages that are to be supplied to the x-ray tube 3, and the filament current setting values at those times, are stored in the storing portion 7 as tables, as illustrated in FIG. 1 and FIG. 2.

FIG. 5 (*a*) is a table illustrating the relationships between the tube currents and the tube voltages that are to be supplied to the x-ray tube 3 and the filament current setting values at those times, which are stored in this way. Note that the units associated with the numbers in the table are all A.

As illustrated in this diagram, the filament current setting values for executing the radiographic imaging using the specific tube voltages and tube currents are stored as a table in the storing portion 7. Note that these filament current setting values are derived experimentally in advance. When a value to be used for the tube voltage and/or tube current is not shown in the table, then a value that is interpolated using the table is used.

When the radiographic equipment is used for the first time in a day, the tube current value when x-rays are emitted from the x-ray tube 3 is measured (Step S2). The tube voltage and tube current at this time should match the imaging conditions when performing the first radiographic imaging. Note that instead of measuring the value of the tube current when using the radiographic equipment for the first time in a day, instead the tube current value may be measured after applying a specific filament current to the filament 31 of the x-ray tube 3 for an aging interval.

Following this, the difference between the anticipated value for the tube current, which is set in advance as the tube current value when performing x-ray emission at the filament current that corresponds to the tube current value at that time, and the measured value for the tube current value when actually performing the x-ray emission at that filament current, is measured as a tube current value difference, and an average value over a specific time interval is calculated for this difference (Step S3).

FIG. 6 is a table illustrating the differences, measured every day, between the anticipated values for the tube currents and the measured values for the tube currents.

As illustrated in this table, when, on the first day, the x-ray tube 3 was driven with a filament current value that produced a tube current value of 400 mA, the tube current value that was actually detected by the tube current detecting portion 53, illustrated in FIG. 2, was 414 mA, indicating that the tube current value increased by 3.5% due to degradation of the filament 31. In this case, the tube current value difference was 3.5%. The same was true on the other days as well. Thus, the tube current value difference was calculated in the same manner.

Following this, an evaluation is performed as to whether or not the average value of the tube current value difference over a specific time interval (for example, three days) exceeds a setting value (for example, 5%) that was set in advance (Step S4). If the average value for the tube current difference over the specific time interval does not exceed the setting value that was set in advance, then processing continues until the imaging has been completed (Step S9). On the other hand, if the average value of the tube current difference over the specific time interval exceeds the setting value that has been set in advance, then the filament current setting value in the table that is stored in the storing portion 7 is corrected (Step S5). After this correction, then the past data for the differences between the anticipated values for the tube current and the measured values for the tube current, illustrated in FIG. 6, are cleared.

Note that the correction to the filament current setting value is performed only in the case wherein the tube current value difference occurs in the direction wherein the measured tube current value is larger than the anticipated value for the tube current. That is, when, due to degradation of the filament 31, the measured tube current value becomes larger than the anticipated value for the tube current, then it is necessary to reduce the value of the filament current that is supplied to the filament 31. In contrast, given the fact that the tube current can be expected to increase to some degree as the filament 31 degrades with the passage of time, and given the fact that increasing the filament current, in the direction that would increase the tube current, would be a correction towards the side wherein there would be the risk of an increased likelihood of failure of the x-ray tube 3, when the measured value for the tube current is in the direction of being smaller than the expected value for the tube current, no correction is made to the filament current setting value.

When there is a tube current value difference in the direction wherein the measured value for the tube current is larger than the expected value for the tube current, then, as illustrated in FIG. 5 (*b*), if the tube current value is in a range that is less than 100 mA, then a correction is made wherein each filament current setting value is reduced by 0.01 A. Moreover, if the tube current value is a range that is equal to or greater than 100 mA, then a correction is made wherein each filament current setting value is reduced by 0.02 A. Doing so makes it possible to correct the tube current value, which has become larger due to the degradation of the filament 31, in the direction that reduces the value thereof.

Here these correction values of 0.01 A and 0.02 A for the filament current setting value are minimum correction values that are smaller than a correction value for the filament current corresponding to an electric current value difference of 5%. That is, the correction value of 0.01 A for the filament current setting value when the tube current value is in the range of less than 100 mA is a value corresponding to approximately 2% of the tube current difference value. In this way, correcting the filament current setting value by the minimum correction value, which is smaller than the correction value for the filament current corresponding to the tube current value difference, makes it possible to correct the filament current setting value gradually, even when there is variability in the differences with the passage of time, as illustrated in FIG. 3, or there is a measurement error for the tube current value.

Once the correction to the filament current setting value has been completed, then the frequency of the corrections made to the filament current setting value within a specific time interval is calculated (Step S6). Given this, an evaluation is made as to whether or not the frequency of the corrections to the filament current setting value during the given time interval exceeds a specific frequency (Step S7).

FIG. 7 is a table illustrating the dates of corrections to the filament current setting value and the correction frequency.

In the example illustrated in this table, each time a correction to the filament current setting value has been completed, the frequency of corrections to the filament current setting value over the past one month is calculated. Given this, if, over the past month, corrections have been made three times, then a warning is displayed regarding the service life of the filament (Step S8). The display of this warning is displayed on the displaying portion 62 illustrated in FIG. 1. Moreover, this warning display is also sent, through a connecting portion 61 the connection with a network, such as the Internet, to a service company that performs maintenance on the radiographic equipment. This warning display enables the user and the maintenance technician of the radiographic equipment to anticipate a failure in the radiographic equipment due to the service life of the filament 31 in the x-ray tube 3. This makes it possible to prevent in advance the phenomenon wherein, at the time of an x-ray examination, the x-ray tube 3 suddenly ceases to emit x-rays due to a failure of the filament 31, thus making it possible to prevent in advance the danger to the patient that is the examination subject 1.

Another example according to the present invention will be explained next. FIG. 8 is a table showing the relationships between the tube currents and tube voltages that are to be applied to the x-ray tube 3, and the filament current setting values at those times, in another form of embodiment according to the present invention.

In the example set forth above, a structure is used wherein if the average value for the tube current value difference over the previous three days exceeds 5% in the direction of an increased tube current value, then the filament current setting value in the table stored in the storing portion 7 is corrected in accordance with the magnitude of the tube current value. In contrast, in the present example, a structure is used wherein an evaluation is performed as to whether or not the average value for the tube current value difference over the previous four days exceeds a setting value that has been set in advance (for example, 5%), and if the average value for the tube current value difference over the specific time interval exceeds the setting value that has been set in advance, then the filament current setting value in the table that is stored in the storing portion 7 is corrected in accordance with the direction in which the difference in the tube current value has been produced.

FIG. 8 (*a*), as with FIG. 5 (*a*) in the example described above, is a table illustrating the relationships between the tube current and the tube voltage that are to be applied to the x-ray tube 3, and the filament electric current setting value at that time, which are stored in advance in the storing portion 7, in the initial set up at the time of equipment installation, or the like. In relation to this, FIG. 8 (*b*) shows the table after the filament current setting value has been corrected when the average value of the tube current value difference over the previous four days has exceeded 5% in the direction of an increasing tube current value. In this case, the filament current setting value in the table that is stored in the storing portion 7 has been corrected by being reduced by 0.01 A each time. In contrast, FIG. 8 (*c*) shows a table after correction of the filament current setting value for the case wherein the average value for the tube current value difference over the previous four days exceeds 5% in the direction wherein the tube current value is decreased. In this case, the filament current setting value in the table that is stored in the storing portion 7 is corrected through a 0.01 A increase each time. Doing so makes it possible to correct the filament current setting value corresponding to the tube current value.

Note that in the example set forth above, if the x-ray tube 3 is provided with a pair of filaments, for a large focal point and a small focal point, then the filament current setting value should be corrected each time for each filament.

While in the example set forth above the average value was used as the calculation processing value for the tube current value difference during the specific time interval and the filament current setting value was corrected when the average value for the tube current value difference over the specific time interval exceeded a setting value that was set in advance, the present invention is not limited to such a configuration.

For example, as another example, a weighted average value such that the more recent the tube current value difference, of the tube current value differences over a specific interval, the greater the weighting, where the filament current setting value is corrected when, after calculation processing, the weighted average value exceeds a setting value that is set in advance. Using a weighted average value instead of the average value in this way makes it possible to reflect strongly the current state of the x-ray tube 3 into the calculation results. Note that in this case as well, the filament current setting value is corrected based on the weighted average value for the electric current value difference the tube current value difference) over the specific time interval, making it possible to perform corrections of the tube current value accompanying degradation of the filament 31 in the x-ray tube 3 so as to reduce the effects of the variability in the differences as time elapses, and of measurement error.

Furthermore, a calculation processing value other than the average value or weighted average value may be used as the calculation processing value. That is, insofar as the tube current value difference measured with the passage of time over the specific time interval is used in calculation processing so as to eliminate the effect of variability in the differences with the passage of time and eliminate the effect of measurement errors, another calculation processing method may be applied at instead.

The invention claimed is:

1. Radiographic equipment for detecting, by an x-ray detector, x-rays that have been emitted from an x-ray tube and that have passed through an examination subject, comprising:

storage storing, as a filament current setting value, a filament current that is to be supplied to a filament of the x-ray tube under imaging conditions, from the imaging conditions of the tube current and tube voltage that are supplied to the x-ray tube at the time of radiographic imaging;

a tube current value difference measuring device measuring over time, as a tube current value difference, a difference between an anticipated value for the tube current when x-ray emission is performed at a given filament current and a measured value for the tube current when x-ray emission is actually performed at that filament current; and a filament current setting value correcting device correcting the filament current setting value that has been stored in the storage so that the tube current value difference is reduced, when a calculation processing value from tube current value differences obtained by a plurality of x-ray exposure during a specific period exceeds a setting value that has been set in advance.

2. The radiographic equipment as set forth in claim 1, wherein:

the calculation processing value for the tube current difference during the specific period is a mean value or a weighted average value of the tube current difference.

3. The radiographic equipment as set forth in claim 2, comprising:

a warning display displaying a warning regarding the filament service life when a correcting frequency for the filament current setting value exceeds a specific setting frequency in a given time interval.

4. The radiographic equipment as set forth in claim 1, wherein:

the filament current setting value correcting device corrects the filament current setting value by a minimum correction value that is smaller than a correction value for the filament current corresponding to the current value difference when the calculation processing value for the tube current value difference during the specific interval exceeds a setting value that has been set in advance.

5. The radiographic equipment as set forth in claim 4, wherein:

when the tube current value difference is a difference wherein the tube current value is increased, the filament current setting value correcting device makes a correction to reduce the filament current setting value, and when the tube current value difference is a difference wherein the tube current value is increased, make no correction to the filament current setting value.

* * * * *